US005476148A

United States Patent [19]

LaBonte

[11] Patent Number: 5,476,148

[45] Date of Patent: Dec. 19, 1995

[54] TOOL FOR MAINTAINING WELLBORE PENETRATION

[76] Inventor: Raymond LaBonte, #1 Edgemont Point, St. Albert, Alberta, Canada, T8N 5K2

[21] Appl. No.: 378,802

[22] Filed: Jan. 27, 1995

Related U.S. Application Data

[63] Continuation-in-part of Ser. No. 143,441, Oct. 26, 1993, abandoned.

[51] Int. Cl.[6] ..... E21B 44/00

[52] U.S. Cl. ..... 175/27; 175/322

[58] Field of Search ..... 175/27, 321, 322; 267/125, 135, 162; 464/20, 21

[56] References Cited

U.S. PATENT DOCUMENTS

| | | | |
|---|---|---|---|
| RE 28,768 | 4/1976 | Mason | 175/297 |
| 2,991,636 | 7/1961 | Warren . | |
| 3,180,437 | 4/1965 | Keliner | 175/230 |
| 3,225,843 | 12/1965 | Ortloff | 175/93 |
| 3,539,026 | 11/1970 | Sutliff et al. | 175/299 |
| 3,804,185 | 4/1974 | Mason | 175/297 |
| 3,871,193 | 3/1975 | Young | 175/321 X |
| 3,949,150 | 4/1976 | Mason et al. | 175/321 |
| 3,963,228 | 6/1976 | Karle | 175/321 X |
| 4,133,516 | 1/1979 | Jurgens | 175/321 X |
| 4,186,569 | 2/1979 | Aumann | 175/321 X |
| 4,194,582 | 3/1980 | Ostertag | 175/321 |
| 4,211,290 | 7/1980 | Mason | 175/321 |
| 4,230,197 | 10/1980 | Wenzel | 175/397 |
| 4,246,765 | 1/1981 | Zabcik | 64/23 |
| 4,254,837 | 3/1981 | Jones | 175/321 X |
| 4,276,947 | 7/1981 | Garrett | 175/321 |
| 4,281,726 | 8/1981 | Garrett | 175/321 |
| 4,394,884 | 7/1983 | Skipper | 175/321 |
| 4,434,863 | 3/1984 | Garrett | 175/321 |
| 4,466,496 | 8/1984 | Jones | 175/67 |
| 4,552,230 | 11/1985 | Anderson et al. | 175/321 |

(List continued on next page.)

FOREIGN PATENT DOCUMENTS

| | | |
|---|---|---|
| 1221960 | 5/1987 | Canada . |
| 1226274 | 9/1987 | Canada . |
| 2058703 | 5/1992 | Canada . |

OTHER PUBLICATIONS

Composite Catalogue of Oilfield Equipment and Services (1992–1993), Vol. 1, pp. 402, 403, 405 and 407, published by Gulf Publishing Company, Houston, Tex.

Cougar Toll Brouchure, ST–2 Shock Tool.

Cougar Tool Brochure, ST–5 Steel Spring Shock Tool.

Cougar Tool Brochure, DJ–4 Locking Hydraulic Drilling Jar.

Cougar Tool Brochure, DJ–5 Mechanical Drilling Jar.

Cougar Tool Brochure, DJ–6 Drilling Jar.

*Primary Examiner*—Roger J. Schoeppel

*Attorney, Agent, or Firm*—Rodman & Rodman

[57] ABSTRACT

A tool for connection in a wellbore drill string for maintaining penetration of a drilling bit attached to the drill string when the drill string becomes stuck or hung up during drilling operations. The tool has a telescoping outer member and inner member which form an annular chamber between them which contains a plurality of springs that are selected to provide a desired amount of contraction of the tool when a predetermined axial compressive load is applied through the tool to the drilling bit. The tool also includes interlocking splines on the outer member and the inner member which inhibit rotational movement of the outer member and inner member relative to each other, and the chamber is filled with hydraulic fluid which is pressurized to the hydrostatic pressure of the wellbore adjacent the tool by a floating piston which is movably located in the chamber. In operation, the tool contracts when an axial compressive load is applied through the tool during drilling operations. If the axial compressive load is decreased due to sticking or hangup of the drilling string, the springs operate to extend the tool, thus maintaining a force on the drilling bit which causes the drilling bit to maintain an amount of penetration in the wellbore.

17 Claims, 8 Drawing Sheets

U.S. PATENT DOCUMENTS

| | | | |
|---|---|---|---|
| 4,600,062 | 7/1986 | Teng | 175/322 |
| 4,697,651 | 10/1987 | Dellinger | 175/61 |
| 4,779,852 | 10/1988 | Wassell | 175/321 X |
| 4,844,157 | 7/1989 | Taylor | 166/178 |
| 4,844,181 | 7/1989 | Bassinger | 175/195 |
| 4,862,976 | 9/1989 | Meek | 175/296 |
| 5,083,623 | 1/1992 | Barrington | 175/321 |
| 5,188,191 | 2/1993 | Tomek | 175/321 X |
| 5,224,898 | 7/1993 | Johnson et al. | 175/321 X |

TOOL FOR MAINTAINING WELLBORE PENETRATION

CROSS REFERENCE TO RELATED APPLICATION

This is a continuation-in-part of U.S. patent application Ser. No. 08/143,441, filed Oct. 26, 1993, abandoned.

TECHNICAL FIELD

The present invention relates to a tool for connection in a wellbore drill string having an attached drilling bit. The tool maintains an amount of penetration of the drilling bit when an axial compressive load applied through the tool to the drilling bit by the drill string during normal drilling operations is decreased.

BACKGROUND ART

The wellbores produced by directional drilling can vary from a vertical inclination to a horizontal inclination in an effort to hit the desired target. This may result in sharp curvatures of the wellbore and areas, known as doglegs, where the angle or curvature of the wellbore has significantly changed. The degree of the curvature and inclination of the wellbore may cause problems, particularly when combined with a non-rotating drill string used in directional drilling. The problems which may arise include orientation difficulties, damage to downhole drilling tools and tool failures. In addition, sticking or hangup of the drill string in the wellbore may occur, resulting in inconsistent penetration of the formation by the drilling bit.

The penetration of the drilling bit is directly related to that portion of the load of the drill string which is transmitted to the drilling bit. The load of the drill string is the net combination of the weight of the drill string and any further upward or downward external loads applied to the drill string: Those portions of the drill string located in the area of the dogleg, or in areas of the wellbore with substantial curvature, are most subject to sticking or hangups. Sticking of the drill string within the wellbore is friction related and often caused by differences between the hydrostatic and formation pressures and mud properties. Hangups are often caused by larger drilling tools in the drill string coming in contact with formation bridges or variances in the diameter of the wellbore. Rotating drill strings are less susceptible to sticking and hangup than non-rotating drill strings due to the nature of the friction forces involved as the drill string moves through the wellbore. Rotating drill strings involve kinetic friction forces while non-rotating drill strings involve static friction forces. Static friction forces are greater than kinetic friction forces.

Typically, during normal drilling operations, the load of the drill string causes the drill string to pass through the wellbore without significant sticking or hangup. However, as the drill string passes through the wellbore around a bend or dogleg area, the friction between the drill string and the wellbore increases above that encountered in normal drilling operations and eventually the drill string may stop sliding within the wellbore. If the drill string stops sliding and becomes suspended in a problem area, the load on the drilling bit, as provided through the drill string, lessens and results in a decreased penetration of the drilling bit. Eventually the drilling bit drills off any remaining load on the drilling bit provided through the drill string by drilling out the formation in front of it. This is referred to as "drilling off". With no further load being provided to the drilling bit by the drill string, the penetration of the drilling bit is reduced to nothing. As a result, the drilling bit speeds up and the drilling mud is simply circulated back to the surface. An immobilized drill string may become permanently stuck in the wellbore.

To overcome sticking or hangup of the drill string within the wellbore, an increased load must be applied to the drill string. When the increased load overcomes the static friction between the drill string and the wellbore, the drill string starts to move downward through the wellbore and may do so in a jerky or sudden fashion. Upon release of the stuck drill string, the static friction between the drill string and the wellbore becomes kinetic friction and the bit may be forced downward into the end of the wellbore. If this occurs, the increased load on the drill string may be directly transferred to the drilling bit. If an increase in the load on the drilling bit occurs suddenly enough, there may be a significant increase in resistance to the rotation of the drilling bit and the flow of the drilling mud through the drilling bit as the drilling bit is forced against the end of the wellbore. If the mud motor is incapable of developing sufficient torque to cause the drilling bit to continue to rotate under the conditions encountered, the bit will stop rotating and may become jammed. This, in turn, may cause the mud motor to stall and all further drilling operations to cease until the increased load on the drilling bit is released. The entire drill string may need to be lifted from the bottom of the wellbore to release the load on the drilling bit. In addition, the orientation of the drill string may need to be confirmed prior to resuming the drilling operation. As well, depending upon the severity of the increased load and the erratic movement of the drill string, damage may be caused to the drilling bit and the mud motor.

Many drilling tools have been developed to overcome some of the above noted problems associated with directional drilling. These tools include drilling jars, bumper subs, shock subs and stabilizers. Drilling jars are used to assist in the freeing of a drill string that has become lodged or stuck in the wellbore. Jarring may be applied in both an upward motion and downward motion. To jar in an upward motion, an upward force is applied to the drill string, placing the drilling jar in tension. When a preset triggering plateau is reached, the trigger releases and causes the drill string to be jarred upwards. To jar in a downward motion, a downward compression force is applied which places the drilling jar in compression. When a preset triggering plateau is reached, the trigger releases causing the drill string to be jarred downwards. Bumper subs are similarly used to free a drill string which has become stuck or hung up. Bumper subs are used to apply a downward force on the stuck portion of the drill string by using the weight of the drill string. Shock subs or shock absorbers are used to relieve stresses in the drill string caused by erratic drilling bit motion, such as compression and tension forces from bouncing of the drilling bit and vibrations. Shock subs absorb these loads on the drilling bit and thereby alleviate some of the stresses to the drill string. A typical shock sub is designed to allow for only a minimal amount of movement between the maximum compression and the maximum tension of the tool and in order to be effective, must be designed so that it is capable of absorbing further compressive forces in the drilling string even when the load of the drill string is the maximum load expected to be encountered during normal drilling operations. The result of this is that a shock sub must always run in at least a partially open position, even under the most demanding downhole conditions, or it ceases to have any utility as a shock absorbing tool. Stabilizers are used to assist in maintaining the drill string in a central position in the wellbore, controlling the wellbore diameter and controlling the wellbore angle. None of the existing drilling tools described above are directed at maintaining penetration of the drilling bit when the axial compressive load transmitted to the drilling bit is decreased due to sticking and hangup of the drill string.

In addition to the tools discussed above, U.S. Pat. No. 4,697,651 issued to Dellinger on Oct. 6, 1987 describes a method of drilling which is intended to address the problems associated with sticking or hangup of the drilling string encountered during directional drilling. This method utilizes an extension sub having both axially contracted and axially extended positions which provides weight to the drilling bit as it moves from a contracted to an extended position. The method includes a drilling stroke which is initiated by lifting the drilling bit about 30 feet above the wellbore bottom and then imparting both rotation and a rapid dynamic movement downward to the drilling bit so that the drilling bit impacts the wellbore bottom and thereby contracts the extension sub. Once the extension sub is contracted, it apparently becomes locked in the contracted position so that the drilling bit can then be raised off the wellbore bottom and oriented in the desired direction, following which the extension sub is released from its contracted position so that it can extend against the wellbore bottom, thus effecting the drilling stroke. Once the extension sub becomes extended, the drilling stroke is repeated. There are several disadvantages of the method described in U.S. Pat. No. 4,697,651. First, the drilling bit must be lifted from the wellbore bottom in order to orient the drilling bit prior to the drilling stroke, thus disrupting the drilling process. Second, the extension sub can only be contracted by imparting a rapid dynamic movement downwards from a significant distance above the wellbore bottom, resulting in high dynamic loading on the drill string and potential damage to the drilling bit and the mud motor. Third, the method is clearly not applicable to normal drilling operations, where the intent is to minimize erratic movement of the drill string in order to avoid wear and tear on the drilling equipment.

There is therefore a need in the industry for a tool for connection in a wellbore drill string for maintaining an amount of penetration of a drilling bit attached to the drill string when an axial compressive load applied through the tool to the drilling bit by the drill string during normal drilling operations is decreased.

DISCLOSURE OF INVENTION

The present invention relates to a tool for use in a drill string having an attached drilling bit. The tool maintains an amount of penetration of the drilling bit when an axial compressive load applied through the tool to the drilling bit by the drill string during normal drilling operations is subsequently decreased during an interruption in normal drilling operations due to sticking and hangup of the drill string within the wellbore. In addition, the tool may allow for absorption of increased axial compressive loads applied through the drill string to free the stuck or hung up drill string.

In a first aspect of the invention, the invention is comprised of a tool for connection in a wellbore drill string having an attached drilling bit. The tool maintains an amount of penetration of the drilling bit when an axial compressive load applied through the tool to the drilling bit by the drill string is decreased. The tool is comprised of a tubular outer member and a tubular inner member. The inner member is telescopically received in the outer member in a spaced relationship therewith such that a chamber is formed therebetween. The outer member and the inner member are movable longitudinally relative to each other in order to permit telescoping of the tool between a fully contracted closed position and a fully extended open position. The tool includes means for transferring the axial compressive load from the outer member to the inner member, which means include a first surface located on the outer member which contacts a second surface located on the inner member when the outer member and the inner member are in the fully closed position. The distance between the first surface and the second surface when the outer member and the inner member are in the fully open position is a first distance designated herein as $D_1$. The tool further includes means for connecting the tool into the drill string above the drilling bit so that during normal drilling operations, the axial compressive load contracts the tool and is substantially transmitted to the end of the wellbore. Further, compressible, resilient means are contained within the chamber for extending the tool to the open position. The extending means become compressed during contraction of the tool so that when the axial compressive load applied through the tool is decreased, the tool is urged to extend to the open position in order to maintain an amount of penetration of the drilling bit. The tool is further comprised of means for inhibiting rotational movement of the inner member and the outer member relative to each other, and means for neutralizing the effect of the hydrostatic wellbore pressure on the extending means.

In the first aspect, the extending means are chosen so that when a predetermined maximum tool contraction load is applied to the tool, the tool is in a substantially closed position. The extending means have a spring rate, which is designated herein as S, and may be spring means which are compressed as the tool is moved from the open position towards the closed position. The chamber may be annular and the spring means may be comprised of a plurality of annular disk springs which preferably have a constant spring rate from the fully closed position to the fully open position.

The range of relative longitudinal movement possible between the outer member and the inner member is equal to the first distance $D_1$ and will determine the maximum amount of penetration of the drilling bit occurring when the load is decreased from the maximum tool contraction load to zero. The outer member and the inner member should permit at least 12 inches of longitudinal movement relative to each other. As well, the outer member and the inner member may permit between 12 inches and 72 inches, or preferably about 36 inches, of longitudinal movement relative to each other. The maximum tool contraction load is equal to the spring rate, S, of the extending means multiplied by the first distance, $D_1$, and is preferably chosen to be less than the intended maximum weight on bit, designated herein as $W_B$, that is expected to be encountered during normal drilling operations, so that the tool is operated in the fully closed position during at least some portion of normal drilling operations. The preferred relationship amongst $D_1$, S and $W_B$ in this invention may therefore be described as $D_1 \times S < W_B$.

The neutralizing means may be comprised of a body of operating fluid contained within the chamber surrounding the extending means. The neutralizing means may further include means for pressurizing the body of operating fluid to be substantially equal to the pressure of the wellbore fluids surrounding the tool. The pressurizing means may include the lower portion of the chamber communicating with the wellbore and containing an amount of the wellbore fluids. A floating piston may be movably located within the chamber and which sealingly engages the wall of the chamber. The floating piston may separate the body of operating fluid from the wellbore fluids in order that the pressure of the wellbore fluids in the lower portion of the chamber may be transmitted to the body of operating fluid by movement of the floating piston.

The rotational movement inhibiting means may be comprised of the inner surface of the outer member and the outer surface of the inner member having interlocking longitudinal splines. The splines lock together upon rotational movement of the inner member and the outer member relative to each other but permit telescoping of the tool. The connecting means may include a threaded connection located at each end of the tool.

The contraction of the tool beyond the fully closed position is limited by the second surface on the inner member and the first surface on the outer member which come into contact when the tool is in the fully closed position. To prevent damage to elements of the tool contained within the chamber, and specifically the extending means, the extending means are chosen such that they are not over-compressed when the outer member and the inner member are in the fully closed position. In other words, the maximum compressibility of the extending means, which is a second distance designated herein as $D_2$, from the fully open position to the point where the extending means are fully compressed, is greater than or equal to the first distance $D_1$. The relationship between $D_2$ and $D_1$ in this invention may therefore be described as $D_2 \geqq D_1$. The tool may also include means for limiting the extension of the tool beyond the fully open position, which means may comprise a surface on a coupling on the inner member which contacts a surface on the outer member when the tool is in the fully open position. Preferably, the tool also comprises a washpipe connected to the lower end of the inner member which provides a smooth transition between the inner diameter of the inner member and the inner diameter of the outer member at the lower end of the inner member.

In the preferred embodiment of the invention, the tool is connected into a non-rotating wellbore drill string having a drilling bit operatively connected to a mud motor. In this embodiment, the tool is preferably connected into the drill string above the mud motor.

BRIEF DESCRIPTION OF DRAWINGS

Embodiments of the invention will now be described with reference to the accompanying drawings, in which.

BEST MODE OF CARRYING OUT INVENTION

Figure 1:
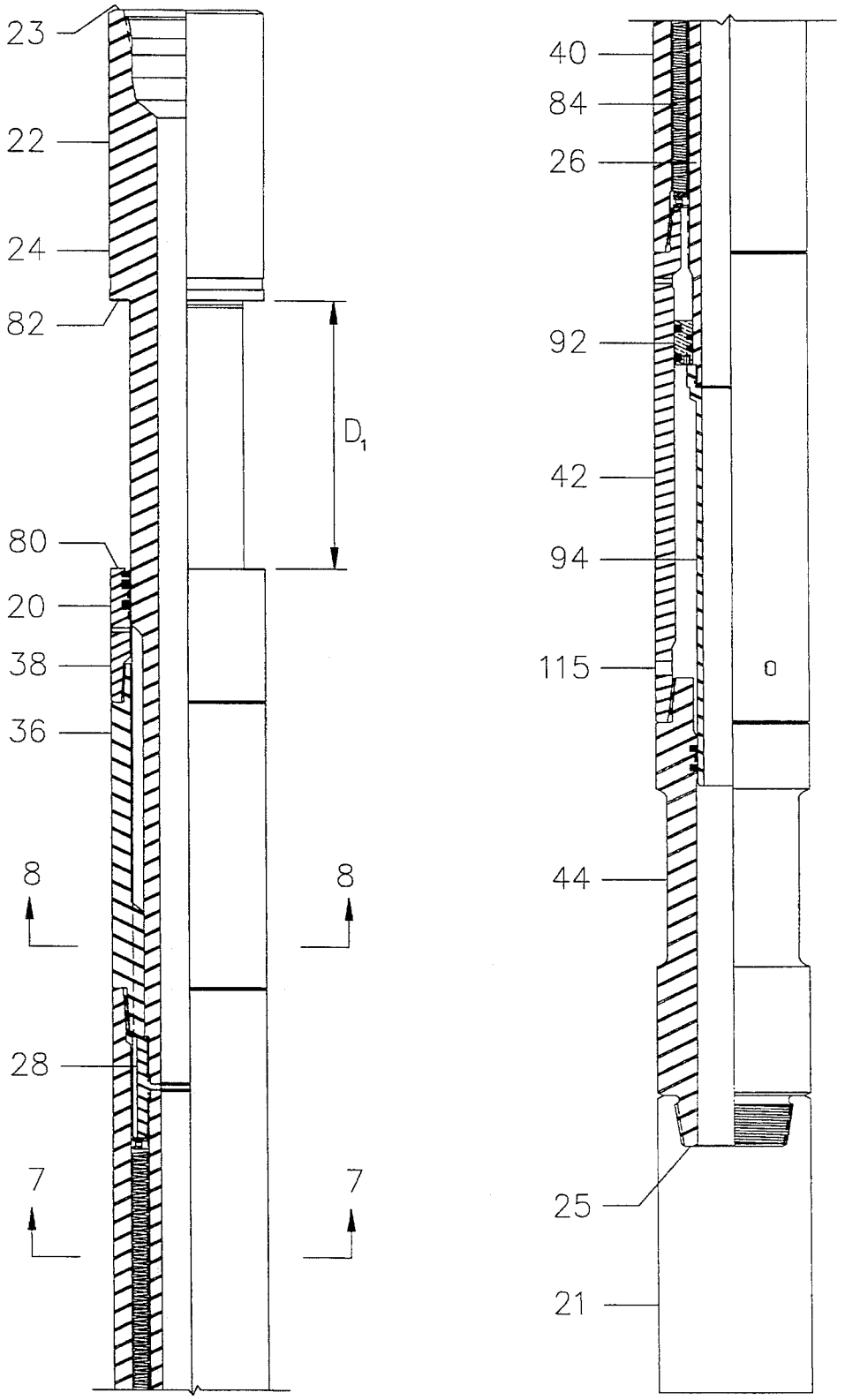
FIG. 1 is a side view of the tool in a fully open position showing a cutaway longitudinal section along one half of the view.
Figure 2:
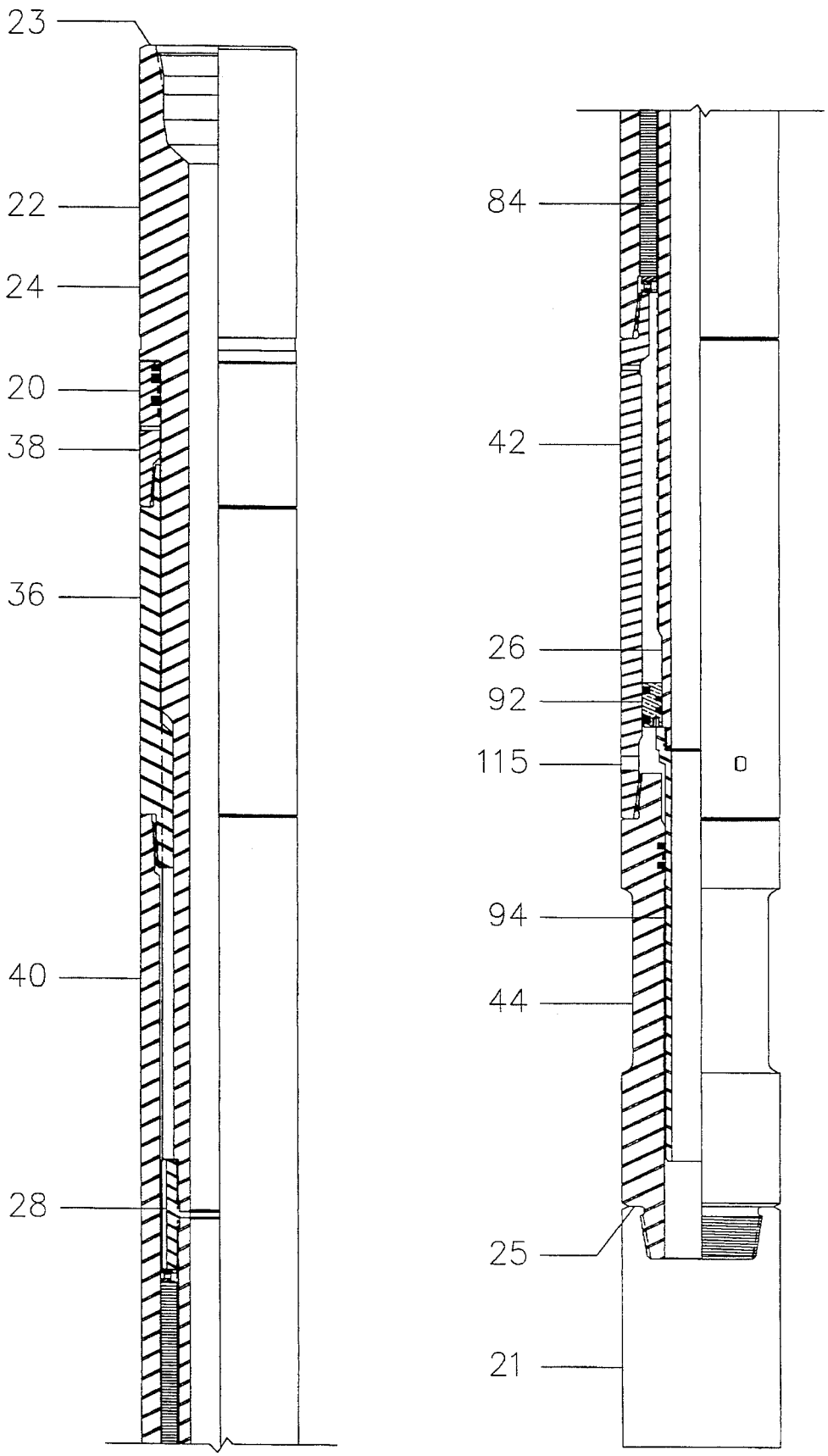
FIG. 2 is a side view of the tool in a fully closed position showing a cutaway longitudinal section along one half of the view.

The invention is comprised of a tool for connection in a drill string having an attached drilling bit. Referring to FIGS. 1 through 6, the tool is comprised of a telescopically relating elongated tubular outer member (20) and an elongated tubular inner member (22). The inner member (22) allows the passage of drilling mud therethrough during the drilling operation. The inner member (22) is received in the outer member (20) such that the longitudinal axes of the inner member (22) and the outer member (20) coincide and the members (22, 20) are movable longitudinally relative to each other in a telescopic manner. The inner member (22) and the outer member (20) may move longitudinally apart to a fully extended open position, as shown in FIG. 1, and may move longitudinally together to a fully contracted closed position, as shown in FIG. 2. The maximum amount of relative longitudinal movement permitted between the inner member (22) and the outer member (20) between the fully open position and the fully closed position is depicted on FIG. 1 as a first distance, $D_1$.

The tool is connected into the drill string in a manner so that during normal drilling operations, an axial compressive load applied through the tool by the drill string contracts the tool and is substantially transmitted to the end of the wellbore. The wellbore runs from the ground surface to the end of the wellbore where the drilling bit (not shown) is applied for further penetration of the formation. The axial compressive load applied through the drill string is comprised of the weight of the drill string plus or minus any external loads applied to the drill string from the surface.

The tool is connected into the drill string so that the axial compressive load is applied to the upper end (23) of the tool. The tool may be located at any point in the drill string above the drilling bit, but is preferably connected into the drill string proximate to and above the mud motor (21) which is in turn operatively connected to the drilling bit for the purpose of rotating the drilling bit during normal drilling operations. In the preferred method of use of the tool, the tool is located directly above the mud motor (21) so that the lower end (25) of the tool is connected to the mud motor (21). As the primary function of the tool is achieved when sticking or hangup of the drill string occurs at a point above the tool, or nearer to the start of the wellbore than the tool, positioning the tool near to the drilling bit decreases the likelihood of any sticking or hangup of the drill string occurring below the level of the tool.

Figure 7:
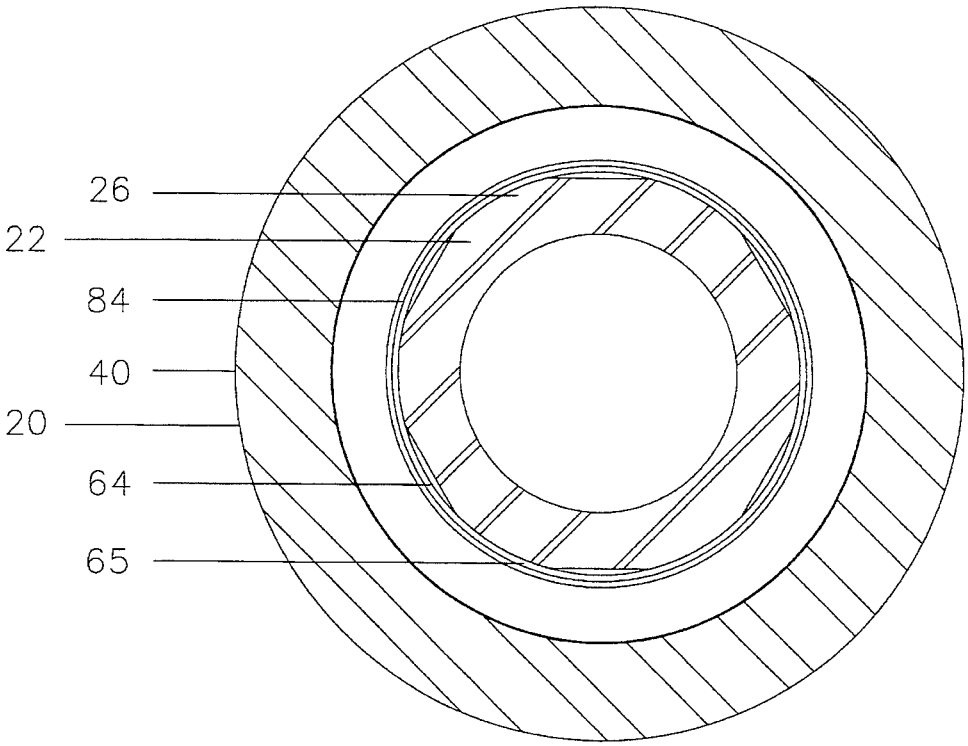
FIG. 7 is a cross-section taken along the line 7—7 on FIG. 1, showing the annular chamber.

As more particularly shown in FIG. 7, the inner member (22) is received in the outer member (20) in a spaced relationship therewith such that an annular chamber (64) is formed between them. The upper portion (65) of the chamber (64) is filled with a body of operating fluid, preferably hydraulic fluid. The upper portion (65) of the chamber (64) containing the hydraulic fluid is sealed in order to prevent the hydraulic fluid from mixing with any wellbore fluids surrounding the tool in the wellbore annulus. The chamber (64) includes five sealing assemblies, described below.

The inner member (22) is comprised of a male spline mandrel (24), a spring mandrel (26) and a coupling (28). The male spline mandrel (24) has an upper end (30) and a lower end (32), the lower end (32) being the end nearest to the attached drilling bit when the tool is connected into the drill string. The lower end (32) includes a threaded pin connection for connection to the coupling (28). The upper end (30) of the male spline mandrel (24) includes a threaded box connection for connecting the inner member (22) into the drill string. The upper end (34) of the spring mandrel (26) also includes a threaded pin connection for connection to the coupling (28). The coupling (28) is comprised of a threaded box connection at each end for receiving the threaded pin connection of the male spline mandrel (24) and the threaded pin connection of the spring mandrel (26). When assembled, the lower end (32) of the male spline mandrel (24) is connected to the upper end (34) of the spring mandrel (26) by the coupling (28) to form the unitary inner member (22), commonly referred to as the inner mandrel.

Figure 4:
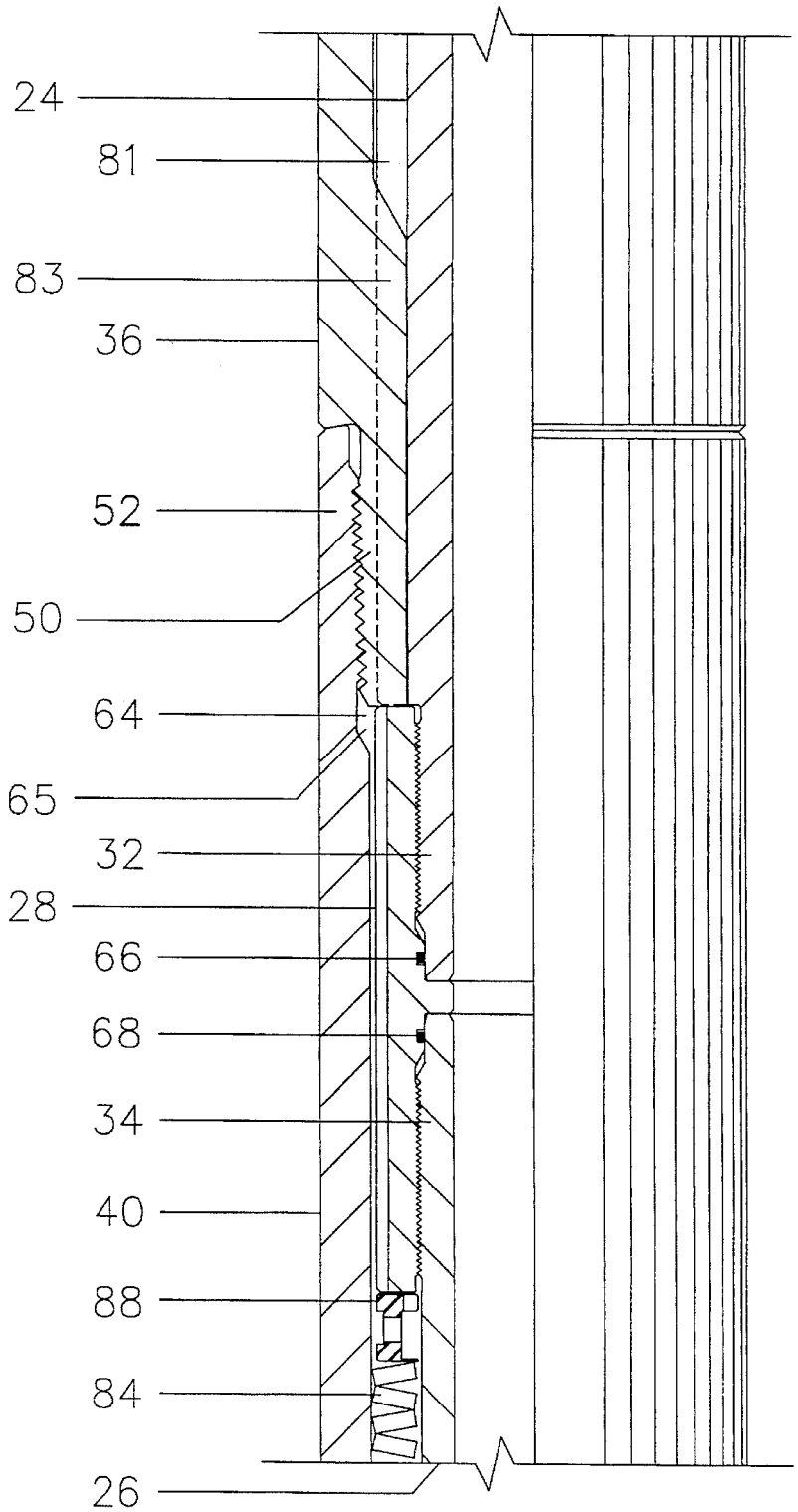

Referring to FIG. 4, a two part first seal assembly is provided with the first part located between the upper end of the coupling (28) and the male spline mandrel (24) and the second part located between the lower end of the coupling (28) and the spring mandrel (26). The first seal assembly inhibits the passage of the drilling mud used in the drilling operation from the inside of the inner member (22) and the passage of hydraulic fluid out of the upper portion (65) of the chamber (64). The first seal assembly is comprised of two O-rings (66, 68), a single O-ring being located in the inside diameter surface of the coupling (28) near the bottom or inner end of each of the threaded box connections. The O-rings (66, 68) form a seal with the outside diameter of the threaded pin connections on the lower end (32) of the male spline mandrel (24) and the upper end (34) of the spring mandrel (26).

The outer member (20) is comprised of a female spline housing (36), a spline cap (38), a spring housing (40), a piston sub (42), and a bottom sub (44). The female spline housing (36) includes a threaded pin connection at each of its ends. The threaded pin connection on the upper end (46) of the female spline housing (36) is connected to the spline cap (38) by a threaded box connection located on the lower end (48) of the spline cap (38). The threaded pin connection on the lower end (50) of the female spline housing (36) is connected to the spring housing (40) by a threaded box connection located on the upper end (52) of the spring housing (40). The lower end (54) of the spring housing (40) includes a threaded box connection for connecting it to the piston sub (42). The piston sub (42) has a threaded pin connection on its upper end (56) for insertion in the threaded box connection of the spring housing (40). The lower end (58) of the piston sub (42) includes a threaded box connection which is connected to the bottom sub (44) by a threaded pin connection on the upper end (60) of the bottom sub (44). The lower end (62) of the bottom sub (44) includes a threaded pin connection for connecting the outer member (20) into the drill string. When assembled, the spline cap (38) is connected to the female spline housing (36), which is connected to the spring housing (40), which is connected to the piston sub (42), which is connected to the bottom sub (44), to form the unitary outer member (20), commonly referred to as the outer housing.

When the inner and outer members (22, 20) are fully contracted together, the tool is in the fully closed position, as shown in FIG. 2. In the fully closed position, an upwardly directed surface or face (80) located at the upper end of the spline cap (38) comes into contact with a downwardly directed surface or face (82) located at the upper end (30) of the male spline mandrel (24). When this position is reached, further closure of the tool is prevented in order to prevent damage to the tool and in particular, to elements of the tool contained within the upper portion (65) of the chamber (64). In addition, the axial compressive load being applied through the tool is transferred to the outer member (20) from the more delicate and thinner walled inner member (22) when the tool is in the fully closed position, thus reducing the risk of damage to the inner member due to excessive axial compressive loading.

When the inner and outer members (22, 20) are fully extended apart, the tool is in the fully open position, as shown in FIG. 1. In the fully open position, the lower end (50) of the female spline housing (36) comes into contact with the upper end of the coupling (28). When this position is reached, further opening of the tool is prevented, and the axial tensile load being applied through the tool is transferred to the outer member (20) from the inner member via the contact between the lower end (50) of the female spline housing (36) and the upper end of the coupling (28), reducing the risk of damage to the inner member due to excessive axial tensile loading. The distance between the upwardly directed surface (80) on the spline cap (38) and the downwardly directed surface (82) on the upper end (30) of the male spline mandrel (24) when the tool is in the fully open position is the first distance, designated as $D_1$, and is equal to the maximum amount of relative longitudinal movement permitted between the inner member (22) and the outer member (20).

Figure 3:
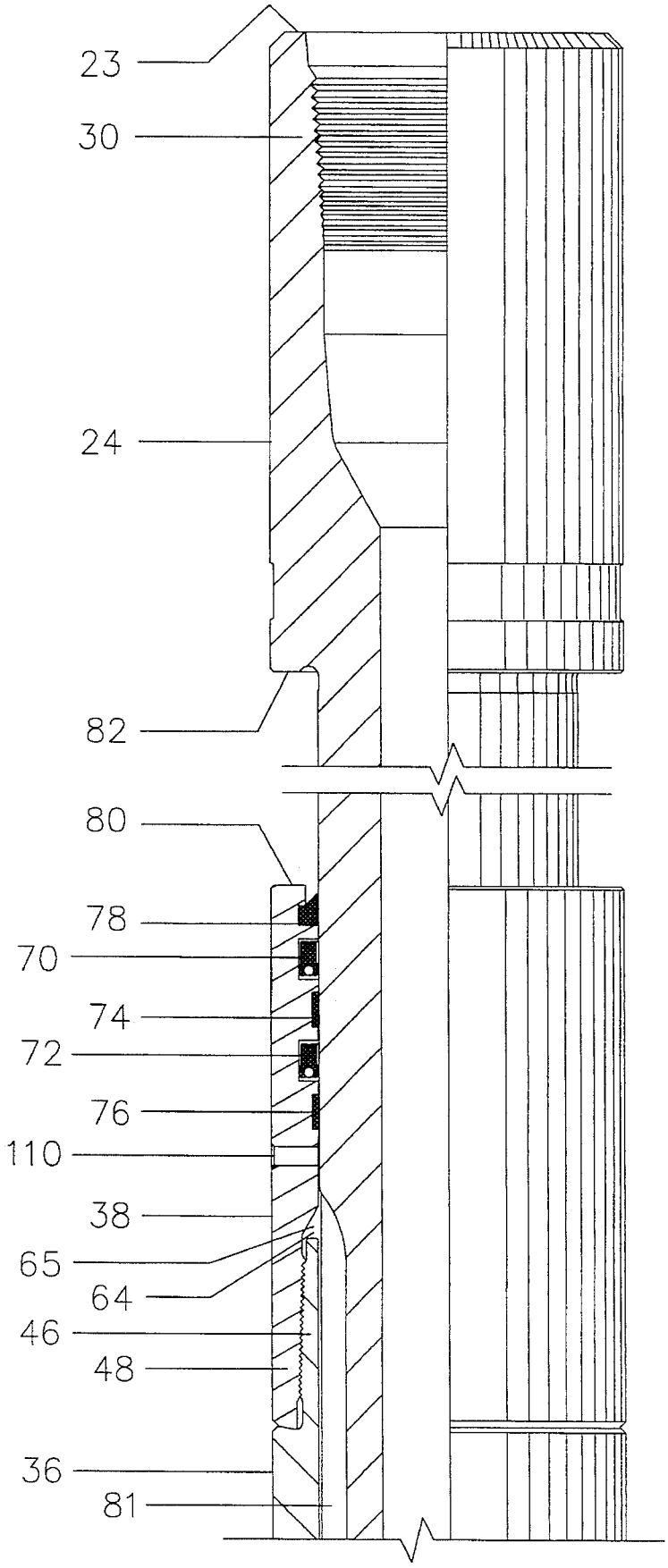
FIGS. 3, 4, 5 and 6 together constitute a more detailed view of FIG. 1, FIGS. 4, 5 and 6 being lower continuations, respectively, of FIGS. 3, 4 and 5.

Referring to FIG. 3, a second seal assembly is located on the inside diameter surface of the spline cap (38) at a point where the inner surface of the spline cap (38) comes into close contact with the outer surface of the male spline mandrel (24). The outside diameter sealing area of the male spline mandrel (24) is preferably chromed to aid in sealing, to decrease friction and to protect against material wear. The second seal assembly is comprised of two polypak type seals (70, 72), two molygard type wear rings (74, 76) and one rod wiper (78). The polypak seals (70, 72) are spaced apart longitudinally on the inside diameter surface of the spline cap (38). They inhibit the passage of any wellbore fluids surrounding the tool into-the chamber (64) and the passage of any hydraulic fluid out of the upper portion (65) of the chamber (64). The two molygard wear rings (74, 76) are interspersed with the polypak seals (70, 72) and may help protect the polypak seals (70, 72) from premature wearing. The molygard wear rings (74, 76) may also add stability to the telescopic movement of the inner and outer members (22, 20). The rod wiper (78) is located at the upper end of the spline cap (38) closer to the face (80) of the spline cap (38) than the polypak seals (70, 72) and the molygard wear rings (74, 76). Although located adjacent to the face (80), the rod wiper (78) is placed completely on the inner diameter surface of the spline cap (38) in order to avoid any damage to it when the tool is moved to the closed position. The purpose of the rod wiper (78) is to clean the surface of the male spline mandrel (24) to aid in achieving a better seal.

Figure 8:
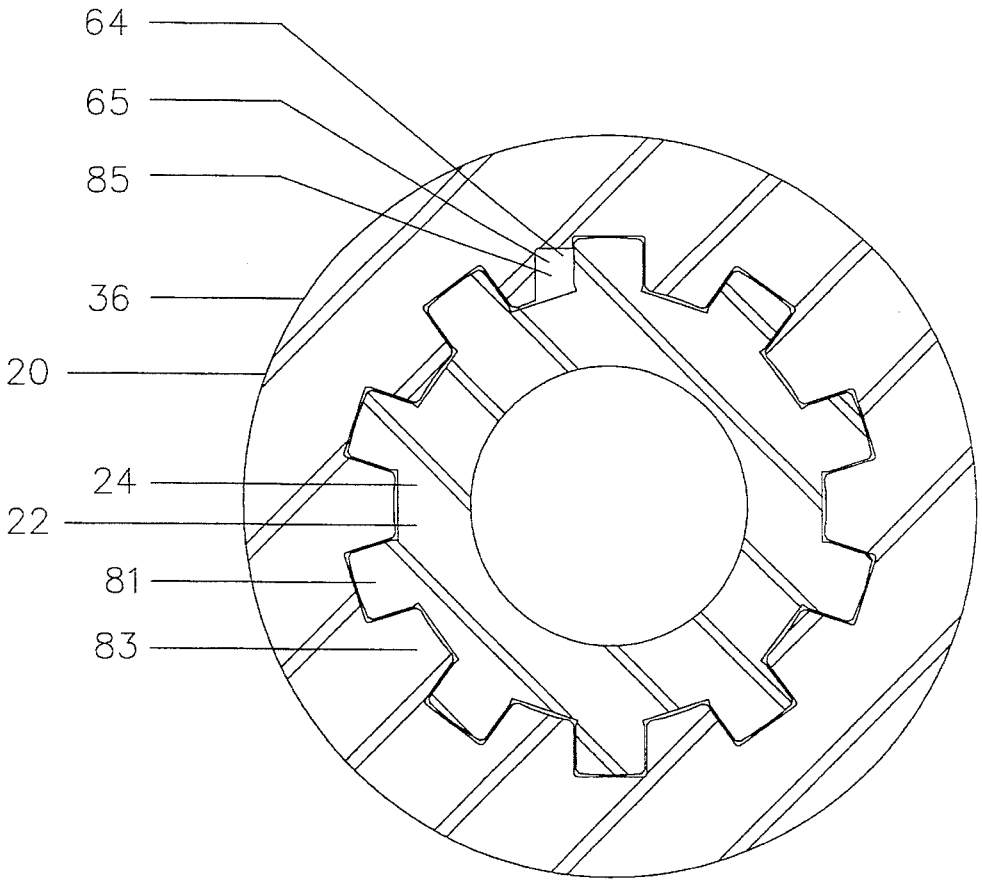
FIG. 8 is a cross-section taken along the line 8—8 on FIG. 1, showing the spline assembly of the inner and outer members.

The tool further includes means for inhibiting the relative rotational movement of the inner and outer member (22, 20) to each other while still permitting longitudinal telescopic movement. The inhibiting means are comprised of a spline assembly of interlocking longitudinal splines located on the outer surface of the inner member (22) and the inner surface of the outer member (20). Specifically, referring to FIG. 8, a portion of the outside diameter of the male spline mandrel (24) includes a square key drive arrangement (81) cut parallel to its longitudinal axis. A portion of the inside diameter of the female spline housing (36) includes a square key drive arrangement (83) cut parallel to its longitudinal axis, which is compatible with the square key drive arrangement (81) of the male spline mandrel (24). The compatible key drives (81, 83) of the male spline mandrel (24) and the female spline housing (36) lock together on rotational movement in order to prevent relative rotational movement of the inner and outer members (22, 20) to each other, without interfering with the telescoping of the tool. The key drive (83) on the female spline housing (36) has an extended cut key (85) for transportation of the hydraulic fluid in the upper portion (65) of the chamber (64). Therefore, unrestricted movement of the hydraulic fluid in the upper portion (65) of the chamber (64) can occur during movement of the tool between the open and closed positions.

The upper portion (65) of the chamber (64) contains compressible, resilient means for extending the tool to the open position. The extending means have a spring rate, S, and become compressed during contraction of the tool or movement of the tool from the open position to the closed position. When partially or fully contracted, the extending means urge the tool to extend to the fully open position. As a result, when the load applied through the tool by the drill string during normal drilling operations is decreased due to sticking or hangup of the drill string in the wellbore above the tool, the tool is urged to the open position by the extending means. In this manner, an amount of penetration of the drilling bit is maintained.

Normal drilling operations occur when for any given axial compressive load applied through the tool by the drill string, the drill string moves through the wellbore as the drilling bit drills out the formation without significant sticking or hangup of the drill string, but allowing for some impediment to movement resulting from typical frictional forces between the wellbore and the drill string. The axial compressive load applied through the tool to the drilling bit is sometimes referred to as the "weight on bit". When using the tool in the drill string and when normal drilling operations are taking place, the axial compressive load through the tool is substantially equal to the force exerted by the extending means and neither contraction nor extension of the tool occurs. Substantial equilibrium therefore exists between the two opposing forces of the axial compressive load and the extending means. When hangup or sticking of the drill string occurs, the axial compressive load applied through the tool becomes less than the force of the extending means and the tool extends. Alternatively, if the axial compressive load applied through the tool increases for any reason, it may become greater than the force of the extending means and the tool contracts.

The upper portion (65) of the chamber (64) is designed, and the extending means are preferably chosen so that when a predetermined maximum tool contraction load is applied through the tool, the tool is contracted to a substantially closed position. Therefore, the maximum tool contraction load is determined or selected as the load required to be applied to the tool to overcome the force of the extending means such that the tool is moved to the fully closed position. In other words, the maximum tool contraction load is equal to the spring rate, S, of the extending means, multiplied by the first distance, $D_1$. To prevent damage to the extending means, the extending means are chosen such that they are not over-compressed when the outer member and the inner member are in the fully closed position. To accomplish this, the maximum compressibility of the extending means, which is a second distance, $D_2$ from the fully open position to the point where the extending means are fully compressed, is greater than or equal to the first distance, $D_1$. The relationship between $D_2$ and $D_1$ in this invention may therefore be described as $D_2>D_1$. Preferably, the maximum tool contraction load is applied during normal drilling operations. However, the axial compressive load applied through the tool by the drill string during normal drilling operations may be less than or greater than the maximum tool contraction load. If the axial compressive load is less than the maximum tool contraction load, the tool will maintain a partially extended position. If the axial compressive load is greater than the maximum tool contraction load, the tool will be fully contracted until the axial compressive load is decreased to less than the maximum tool contraction load. As the axial compressive load applied through the tool becomes closer to the maximum tool contraction load, or if it exceeds the maximum tool contraction load, the more rigid the tool becomes. As a result, it is preferred that the tool be used in combination with a bottom hole shock sub when an axial compressive load equal to or greater than the predetermined maximum tool contraction load is to be applied through the tool to the drilling bit. In other words, when the intended maximum weight on bit, designated as $W_B$, equals or exceeds the maximum tool contraction load, additional shock absorbing capability may be desirable. In the preferred embodiment, the extending means are chosen such that the tool is operated in the fully closed position during at least some portion of normal drilling operations, which means that the maximum tool contraction load is less than the intended maximum weight on bit, $W_B$. The relationship amongst $D_1$, S, and $W_B$ in the preferred embodiment may therefore be described as $D_1 \times S < W_B$.

In the preferred embodiment, the extending means are comprised of spring means which are compressed as the tool is moved from the open position to the closed position. Preferably, the spring means are comprised of a plurality of annular disk springs (84) stacked on top of one another. However, any form of compressible, resilient material in the form of gases, liquids and solids, including any sufficient form of rubber or springs, may be used. The number and configuration of the disk springs used will vary depending upon, amongst other factors, the desired maximum tool contraction load, the maximum weight on bit to be applied through the tool, the type of springs used, and the desired amount of movement of the tool between the fully open and fully closed positions. The chamber (64) may not have to be annular, depending upon the specific spring means that are chosen.

The springs (84) are located in the upper portion (65) of the chamber (64) defined by the spring mandrel (26) and the spring housing (40). The springs (84) are secured longitudinally within the upper portion (65) of the chamber (64) between the upper by-pass ring (88) adjacent the lower end of the coupling (28) and the lower by-pass ring (90) adjacent the upper end (56) of the piston sub (42) in a manner such that as the tool is closed the springs (84) are compressed therebetween. Referring to FIG. 7, the spring mandrel (26) is bevelled to allow unrestricted movement of the hydraulic fluid between the outside diameter of the spring mandrel (26) and the inside diameter of the springs (84) when the springs (84) are compressed.

The disk springs (84) are preferably of a concave, circular shape to fit within the annular chamber (64) and are designed to absorb shock upon compression and to return to their original shape when the compressive forces are removed. Preferably the disk springs (84) have a constant spring rate from the fully closed position to the fully open position. In other words, it is preferred that the amount of compression of the stack of disk springs vary linearly in proportion to the axial compressive load applied through the tool.

The components of the tool, including the springs (84), are chosen and assembled to achieve a specific amount of maximum longitudinal movement between the inner and outer members (22, 20). The amount of maximum longitudinal movement determines the maximum amount of penetration of the drilling bit occurring when the axial compressive load, or weight on bit, is decreased. Preferably, the inner and outer members (22, 20) permit about 36 inches of longitudinal movement relative to each other, but any amount of longitudinal movement between the inner and outer members (22, 20) may be provided for. However, to allow the most effective functioning of the tool, the inner and outer members (22, 20) should permit at least 12 inches of longitudinal movement relative to each other, to a maximum of 72 inches.

Figure 5:
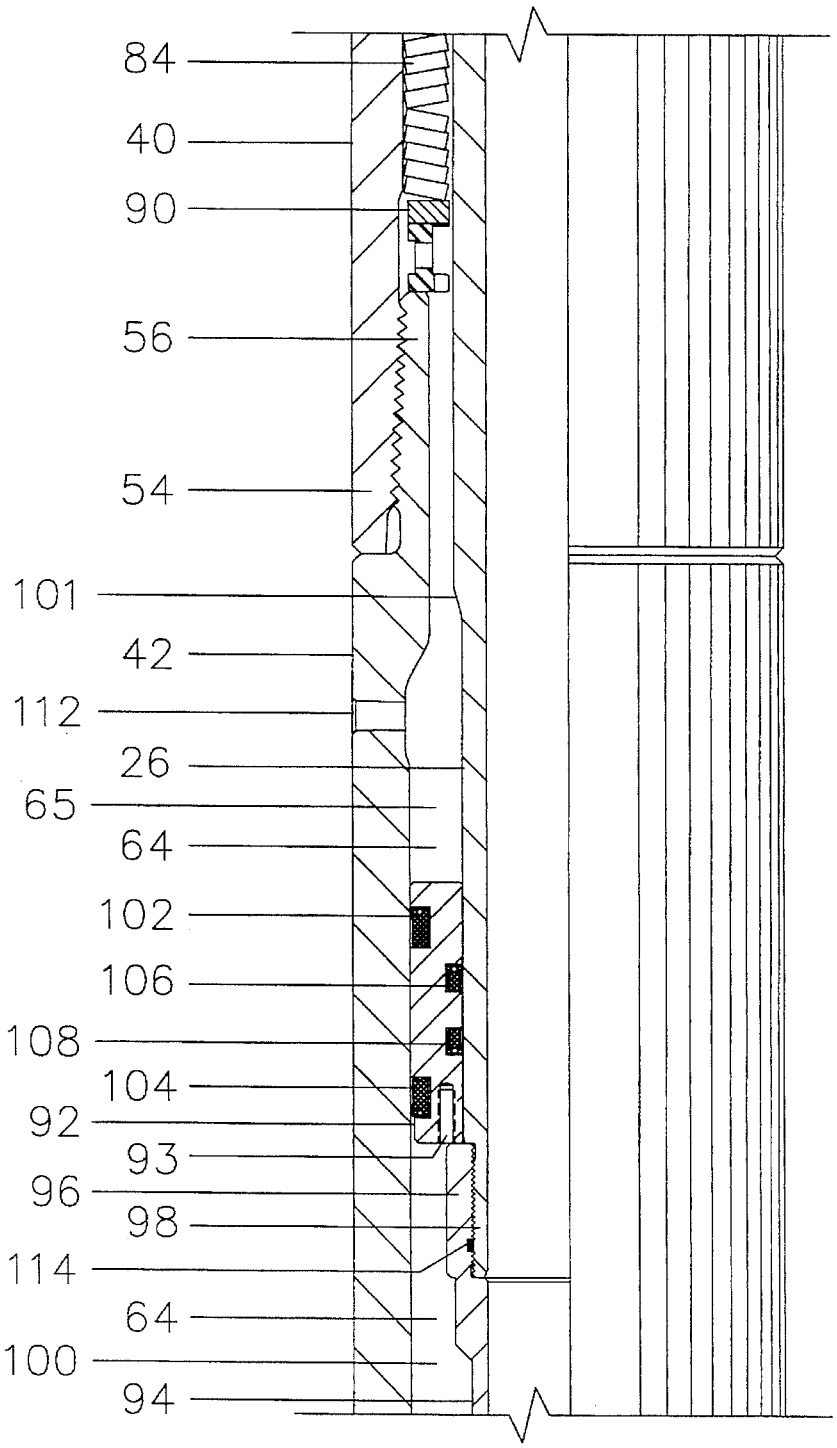
Figure 6:
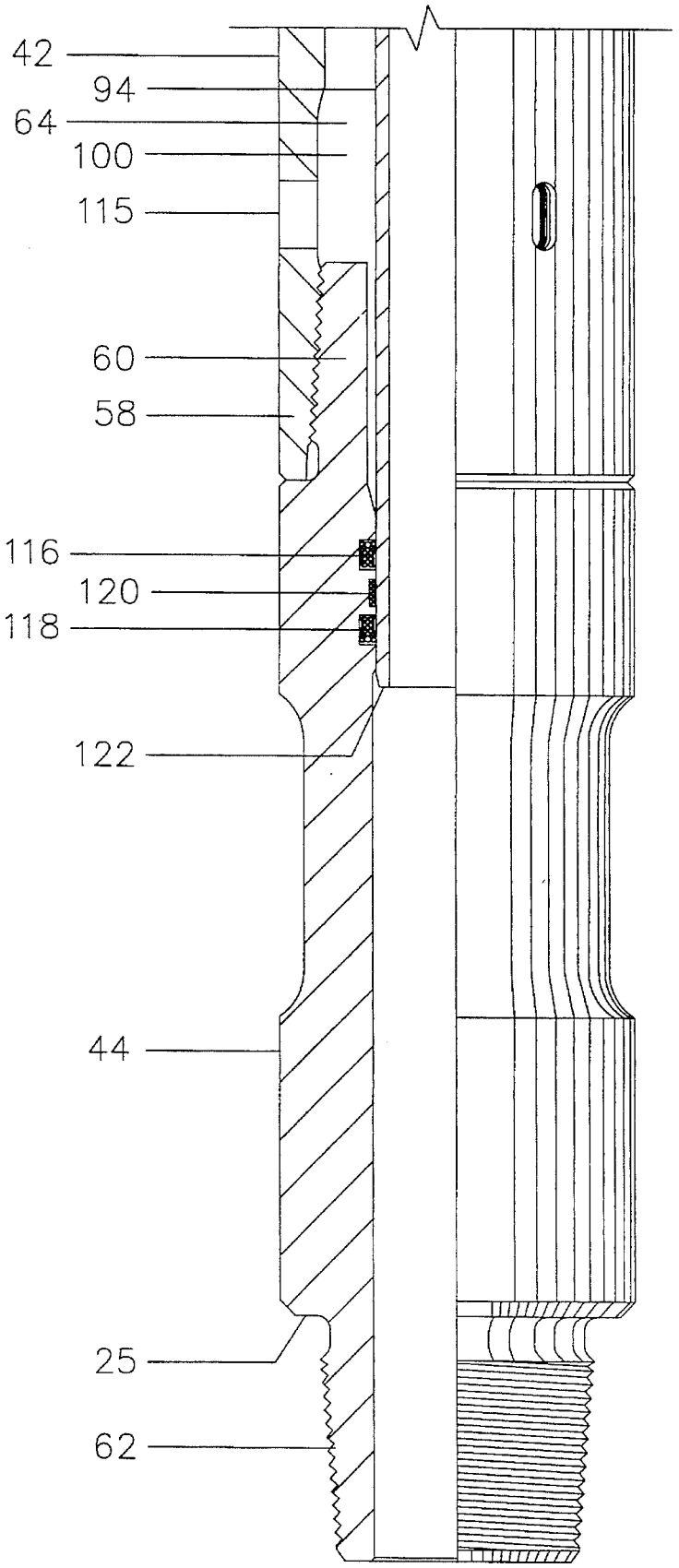

Referring to FIGS. 4, 5 and 6, the chamber (64) also contains the upper and lower by-pass rings (88, 90), and a compensating piston (92). The upper by-pass ring (88) is placed longitudinally between the lower end of the coupling (28) and the upper end of the springs (84). The lower by-pass ring (90) is placed longitudinally between the upper end (56) of the piston sub (42) and the lower end of the springs (84). The upper and lower by-pass rings (88, 90) are ported to allow hydraulic fluid to by-pass them in order that the movement of the hydraulic fluid in the upper portion (65) of the chamber (64) is unrestricted. In addition, the placement of the by-pass rings (88, 90) does not affect the deformation or compression of the springs (84) and the compression of the springs (84) does not restrict the movement of the hydraulic fluid through the by-pass rings (88, 90).

The compensating piston (92) is contained within the chamber (64) below the upper end (56) of the piston sub (42). The compensating piston (92) is a floating piston which divides the chamber (64) into the upper portion (65) and a lower portion (100). Two NPT type taps (93) are located on its bottom face to facilitate removal of the compensating piston (92) for servicing of the tool. The compensating piston (92) has a limited amount of travel or movement within the chamber (64) so that the compensating piston (92) will not compress the springs (84) during use of the tool. The upward movement of the compensating piston (92) is limited by the top of the piston sub (42) and by a shoulder (101) on the spring mandrel (26). Therefore, the compensating piston (92) is unable to move upwards beyond the upper end (56) of the piston sub (42) or beyond the shoulder (101) on the spring mandrel (26). The downward movement of the compensating piston (92) is limited by a washpipe (94) which is connected to the lower end (98) of the spring mandrel (26) and protrudes into the lower portion (100) of the chamber (64). The lower end (98) of the spring mandrel (26) includes a threaded pin connection for insertion in a threaded box connection on the upper end (96) of the washpipe (94). The lower end (122) of the washpipe (94) comes into close contact with the upper end (60) of the bottom sub (44). The chamber (64) terminates at its lower end at the top of the bottom sub (44).

The lower end (58) of the piston sub (42), above its threaded connection, contains a port (115) to allow the wellbore fluids surrounding the tool to enter the lower portion (100) of the chamber (64). As stated, the lower portion (100) is distinct and separate from the upper portion (65) of the chamber (64), the two portions (65, 100) of the chamber (64) being separated by the compensating piston (92). Thus, the hydraulic fluid in the upper portion (65) of the chamber (64) is kept separate and apart from the wellbore fluids entering the lower portion (100). The third seal assembly in the tool assists the compensating piston (92) in accomplishing this purpose.

Referring to FIG. 5, the third seal assembly in the tool is comprised of four polypak type seals. Two outer polypak seals (102, 104) are located on the outside diameter surface of the compensating piston (92) to seal with the inner diameter surface of the piston sub (42). Two further inner polypak seals (106, 108) are located on the inside diameter surface of the compensating piston (92) to seal with the outside diameter surface of the spring mandrel (26). The outside diameter surface of the spring mandrel (26) is preferably chromed to aid in ensuring a proper seal, to decrease friction and to protect against material wear. As a result, the hydraulic fluid in the upper portion (65) of the chamber (64) is inhibited from moving into the lower portion (100) and the wellbore fluids in the lower portion (100) of the chamber (64) are inhibited from passing into the upper portion (65).

Referring to FIGS. 3 and 5, the upper portion (65) of the chamber (64) is filled with hydraulic fluid by means of two threaded taps. A first threaded tap (110) is located in the spline cap (38) and a second threaded tap (112) is located in the piston sub (42) above the compensating piston (92). Once the upper portion (65) of the chamber (64) is filled with hydraulic fluid through the taps (110, 112), the hydraulic fluid is secured in the upper portion (65) of the chamber (64) by two NPT type pipe plugs.

The hydraulic fluid serves two primary purposes. First, it serves to lubricate all movable components and seals which are in contact with the hydraulic fluid. Second, the hydraulic fluid aids in minimizing any preloading to the springs (84) from hydrostatic wellbore pressure produced by wellbore fluids surrounding the tool. The minimization of preloading is accomplished by using the compensating piston (92) and the lower portion (100) of the chamber (64) containing the wellbore fluids.

The wellbore fluids are allowed to enter the lower portion (100) of the chamber (64) through the port (115). Thus, the hydrostatic pressure from the wellbore fluids may act upon the floating or movable compensating piston (92). The hydrostatic pressure of the wellbore fluids moves the compensating piston (92) which results in compression of the hydraulic fluid in the upper portion (65) of the chamber (64). The amount of movement of the compensating piston (92) is determined by the difference between the hydrostatic pressure of the hydraulic fluid in the upper portion (65) of the chamber (64), and the hydrostatic pressure of the wellbore fluids in the lower portion (100) of the chamber (64). However, the maximum upward movement of the compensating piston (92) is limited by the upper end (56) of the piston sub (42) and by the shoulder (101) on the spring mandrel (26) in order to avoid compression of the springs (84) by the compensating piston (92).

The compensating piston (92) will slide and compress the hydraulic fluid until the hydrostatic pressure of the hydraulic fluid in the upper portion (65) of the chamber (64) equals the hydrostatic pressure of the wellbore fluids in the lower portion (100) of the chamber (64). Since the hydraulic fluid undergoes pressurization, and a pressure balance is achieved with the hydrostatic wellbore pressure, the springs (84) are not affected by the hydrostatic pressure of the wellbore fluids surrounding the tool which would otherwise tend to contract the tool. The springs (84) are therefore not compressed or preloaded by the wellbore pressure and will only compress when an axial compressive load is applied through the tool which moves the tool towards the closed position.

Two further seal assemblies in the tool surround the lower portion (100) of the chamber (64). Referring to FIG. 5, the fourth seal assembly in the tool is comprised of a single O-ring (114) located between the washpipe (94) and the spring mandrel (26). The O-ring (114) is located on the inside diameter surface of the threaded box connection at the upper end (96) of the washpipe (94) and seals to the outside diameter surface of the threaded pin connection at the lower end (98) of the spring mandrel (26). The O-ring (114) aids in preventing possible washouts and the passage of drilling mud travelling through the inner member into the lower portion (100) of the chamber (64).

Referring to FIG. 6, the fifth seal assembly is located between the washpipe (94) and the bottom sub (44). The seal assembly is comprised of two polypak type seals (116, 118) and a wear ring (120). The polypak seals (116, 118) are located above and below the wear ring (120) on the inside diameter surface adjacent the upper end (60) of the bottom sub (44). The polypak seals (116, 118) seal to the outside diameter surface of the lower end (122) of the washpipe (94). The polypak seals (116, 118) aid in preventing drilling mud passing through the inner member (22) from entering the wellbore via the port (115) in the piston sub (42). The wear ring (120) is located between the polypak seals (116, 118), and acts to centralize the outside diameter surface of the washpipe (94) and to decrease the wear on the seals (116, 118). In addition, the outside diameter surface of the washpipe (94) is preferably chromed to aid in achieving a better seal, to decrease friction and to help protect against material wear.

The washpipe (94) is designed both to aid in preventing drilling mud passing through the inner member (22) from entering the wellbore via the port (115) in the piston sub (42), and to reduce the amount of unwanted tool opening caused by the force of the pressurized drilling mud being exerted on the bottom sub (44) after exiting the bottom of the inner member (22). This force is referred to as "pump open" or "pump apart" force. The area formed by the difference between the inside diameter of the inner member (22) and the inside diameter of the bottom sub (44) is directly proportional to the amount of pump open force where no washpipe is utilized. In the tool, the washpipe (94) forms a smooth transition between the spring mandrel (26) and the bottom sub (44) by minimizing this area and thus minimizing the pump open force.

In the preferred embodiment in which the inner and outer members (22, 20) permit 36 inches of longitudinal movement relative to each other, and assuming the tool is in the fully closed position when the axial compressive load applied through the tool is decreased to zero, the tool will be capable of drilling the wellbore forward a maximum distance of 36 inches without any axial compressive load being applied through the tool by the drill string. In this manner, the drilling bit will rotate and penetration will continue while the drill string is stuck or hung up. This allows the operator a period of time to recognize that the drill string is stuck or hung up and to get it moving again, while the tool keeps the drilling bit applied against the formation at the end of the wellbore for continued penetration. For instance, assuming one unit of time per inch of longitudinal movement of the drilling bit, the drill string could be stuck for a total of 36 units of time before the drilling bit would stop cutting against the formation.

Once the operator is alerted to the fact that the drill string is stuck or hung up and no longer moving through the wellbore, an additional axial compressive load may be applied to the drill string in order to cause it to slip downward in the wellbore. If, for example, it takes the operator 12 units of time to free the drill string, the tool will permit the drilling bit to continue to drill against the formation during that time period. In addition, when the drill string is freed, it may move downward in the wellbore up to 12 inches before the drill string will place excessive force on the drilling bit against the formation. In other words, as the drill string moves forward, the springs (84) may be compressed until the tool reaches the fully closed position before the drilling bit will be jammed into the formation. In addition, if the drill string moves forward in a jerking or erratic fashion at varied rates of movement, the tool will maintain penetration of the drilling bit during the slower periods and absorb any sudden increase in force on the drilling bit if the drill string moves forward more quickly.

If greater than 36 units of time are required to free the drill string, the drilling bit will rotate freely. When the drill string suddenly starts to move forward, the drilling bit will contact the surface, the resistance to the flow of the drilling mud will increase and the drilling bit will begin to drill. As long as the drill string does not suddenly move forward greater than 36 inches, the drilling bit will not be jammed suddenly into the formation.

As indicated above, it is sometimes desirable to use the tool in conjunction with a bottom hole shock sub, particularly where the axial compressive load applied through the tool to the drilling bit is expected to exceed the maximum tool contraction load. However, the tool may also be used in combination with other conventional drilling tools, such as jarring tools. When jarring upward, the tool is moved to the open position prior to the jarring tool reaching its trigger plateau. When the jarring tool fires, the open position of the tool causes it to act as a solid member and there is no absorption of forces by the springs (84). When jarring downward, the tool is moved to the closed position prior to the jarring tool reaching its trigger plateau. When the jarring tool fires downward, the closed position of the tool causes it to act as a solid member and there is no absorption of forces by the springs (84). The springs (84) therefore do not interfere with either the upward or downward jarring action and are not damaged by such action.

The embodiments of the invention in which an exclusive privilege or property is claimed are defined as follows:

1. A tool for connection in a wellbore drill string for use in a subterranean wellbore extending from the surface to an end beneath the surface, for maintaining an amount of penetration of a drilling bit attached to the drill string when an axial compressive load applied through the tool to the drilling bit by the drill string is decreased, the wellbore containing wellbore fluids which exert a hydrostatic pressure on the tool, the tool comprising:

(a) a tubular outer member having an inner surface and an outer surface;

(b) a tubular inner member, having an inner surface and an outer surface, telescopically received in the outer member in a spaced relationship therewith such that the outer member and the inner member form a chamber therebetween having an upper portion and a lower portion, the outer member and the inner member being movable longitudinally relative to each other for an amount of relative longitudinal movement to permit telescoping of the outer member and the inner member between a fully contracted closed position and a fully extended open position;

(c) means for transferring the axial compressive load from the outer member to the inner member including a first surface located on the outer member which contacts a second surface located on the inner member when the outer member and the inner member are in the fully closed position, wherein a first distance, designated as $D_1$, is defined by the distance between the first surface and the second surface when the outer member and the inner member are in the fully open position;

(d) means for connecting the outer member and the inner member into the drill string above the drilling bit so that during normal drilling operations, the axial compressive load contracts the inner member and the outer member and is substantially transmitted to the end of the wellbore;

(e) compressible, resilient extending means contained within the chamber for telescoping the outer member and the inner member towards the fully open position, which extending means become compressed during contraction of the outer member and the inner member during normal drilling operations so that when the axial compressive load applied through the outer member and the inner member is subsequently decreased during an interruption in normal drilling operations due to sticking or hangup of the drill string in the wellbore, the outer member and the inner member are urged to extend towards the fully open position in order to maintain an amount of penetration of the drilling bit, the extending means having a spring rate, designated as S, and a maximum compressibility defining a second distance, designated as $D_2$, such that:

$$D_1 \times S < W_B, \text{ and } D_2 \geqq D_1$$

wherein $W_B$ is an intended maximum weight on bit during normal drilling operations;

(f) means for inhibiting rotational movement of the inner member and the outer member relative to each other; and (g) means for neutralizing the hydrostatic pressure of the wellbore fluids exerted on the extending means.

2. A tool connected into a non-rotating wellbore drill string, for use in a subterranean wellbore extending from the surface to an end beneath the surface, which maintains an amount of penetration of a drilling bit operatively connected to a mud motor connected into the non-rotating drill string when an axial compressive load applied through the tool to the drilling bit by the non-rotating drill string is decreased, the wellbore containing wellbore fluids which exert a hydrostatic pressure on the tool, the tool comprising:

(a) a tubular outer member having an inner surface and an outer surface;

(b) a tubular inner member, having an inner surface and an outer surface, telescopically received in the outer member in a spaced relationship therewith such that the outer member and the inner member form a chamber therebetween having an upper portion and a lower portion, the outer member and the inner member being movable longitudinally relative to each other for an amount of relative longitudinal movement to permit telescoping of the outer member and the inner member between a fully contracted closed position and a fully extended open position;

(c) means for transferring the axial compressive load from the outer member to the inner member including a first surface located on the outer member which contacts a second surface located on the inner member when the outer member and the inner member are in the fully closed position, wherein a first distance, designated as $D_1$, is defined by the distance between the first surface and the second surface when the outer member and the inner member are in the fully open position;

(d) means for connecting the outer member and the inner member into the drill string above the mud motor so that during normal drilling operations, the axial compressive load contracts the inner member and the outer member and is substantially transmitted to the end of the wellbore;

(e) compressible, resilient extending means contained within the chamber for telescoping the outer member and the inner member towards the fully open position, which extending means become compressed during contraction of the outer member and the inner member during normal drilling operations so that when the axial compressive load applied through the outer member and the inner member is subsequently decreased during an interruption in normal drilling operations due to sticking or hangup of the drill string in the wellbore, the outer member and the inner member are urged to extend towards the fully open position in order to maintain an amount of penetration of the drilling bit, the extending means having a spring rate, designated as S, and a maximum compressibility defining a second distance, designated as $D_2$, such that:

$$D_1 \times S < W_B, \text{ and } D_2 \geqq D_1$$

wherein $W_B$ is an intended maximum weight on bit during normal drilling operations;

(f) means for inhibiting rotational movement of the inner member and the outer member relative to each other; and (g) means for neutralizing the hydrostatic pressure of the wellbore fluids exerted on the extending means.

3. The tool as claimed in claim 1 wherein the extending means are comprised of spring means which are compressed as the outer member and the inner member are contracted from the fully open position towards the fully closed position.

4. The tool as claimed in claim 3 wherein the chamber is annular.

5. The tool as claimed in claim 4 wherein the spring means are comprised of a plurality of annular disk springs.

6. The tool as claimed in claim 4 wherein the spring means have a constant spring rate from the fully closed position to the fully open position.

7. The tool as claimed in claim 1, wherein the first distance determines a maximum amount of penetration of the drilling bit occurring when the axial compressive load is decreased from a maximum tool contraction load to zero.

8. The tool as claimed in claim 7 wherein the first distance is at least about 12 inches.

9. The tool as claimed in claim 8 wherein the first distance is between about 12 inches and about 72 inches.

10. The tool as claimed in claim 9 wherein the first distance is about 36 inches.

11. The tool as claimed in claim 1, wherein the neutralizing means are comprised of a body of operating fluid contained within the chamber surrounding the extending means and means for pressurizing the body of operating fluid to be substantially equal to the pressure of the wellbore fluids surrounding the tool.

12. The tool as claimed in claim 11 wherein the pressurizing means are comprised of the lower portion of the chamber communicating with the wellbore and containing an amount of the wellbore fluids, and a floating piston movably located within the chamber and sealingly engaging the inner surface of the outer member and the outer surface of the inner member, the floating piston separating the body of operating fluid from the wellbore fluids in order that the pressure of the wellbore fluids in the lower portion of the chamber may be transmitted to the body of operating fluid by movement of the floating piston.

13. The tool as claimed in claim 1, wherein the rotational movement inhibiting means are comprised of the inner surface of the outer member and the outer surface of the inner member having interlocking longitudinal splines which lock together upon rotational movement of the inner member and the outer member relative to each other but permit telescoping of the tool.

14. The tool as claimed in claim 1, wherein the connecting means are comprised of a threaded connection located at each end of the tool.

15. The tool as claimed in claim 1, further comprising limiting means for preventing the telescoping of the outer member and the inner member beyond the fully open position.

16. The tool as claimed in claim 15 wherein the limiting means comprise a surface on a coupling on the inner member which contacts a surface on the outer member when the outer member and the inner member are in the fully open position.

17. The tool as claimed in claim 1, further comprising a washpipe connected to a lower end of the inner member which provides a smooth transition between an inner diameter of the inner member and an inner diameter of the outer member in order to prevent drilling mud flowing through the tool from entering the wellbore as it exits the lower end of the inner member and enters the outer member.

* * * * *

UNITED STATES PATENT AND TRADEMARK OFFICE

CERTIFICATE OF CORRECTION

PATENT NO. : 5,476,148

DATED : December 19, 1995

INVENTOR(S) : Raymond LaBonte

It is certified that error appears in the above-identified patent and that said Letters Patent is hereby corrected as shown below:

In Column 9, line 57, change "$D_2>D_1$" to --$D_2 \geq D_1$--.

Signed and Sealed this

Seventh Day of May, 1996

Bruce Lehman

*Attest:*

BRUCE LEHMAN

*Attesting Officer*

*Commissioner of Patents and Trademarks*